United States Patent [19]

Lars-Jos

[11] Patent Number: 4,841,577

[45] Date of Patent: Jun. 27, 1989

[54] GLOVE OF CHAIN ARMOUR STRUCTURE

[76] Inventor: Pehr Lars-Jos, Box 6, S-78 200 Malung, Sweden

[21] Appl. No.: 190,772

[22] Filed: May 6, 1988

Related U.S. Application Data

[60] Division of Ser. No. 124,907, Nov. 24, 1987, Pat. No. 4,802,242, which is a continuation of Ser. No. 21,592, Mar. 2, 1987, abandoned, which is a continuation-in-part of Ser. No. 780,653, Sep. 26, 1985, abandoned.

[30] Foreign Application Priority Data

Sep. 28, 1984 [NO] Norway ..... 843936

[51] Int. Cl.[4] ..... A41D 19/00

[52] U.S. Cl. ..... 2/161 R; 2/167

[58] Field of Search ..... 2/2, 159, 161 R, 167

[56] References Cited

U.S. PATENT DOCUMENTS 280,823 7/1883 Hoffman ..... 2/167 X
763,736 6/1904 Doppenschmitt ..... 2/167 X
4,493,865 1/1985 Kuhlmann et al. ..... 2/167
4,750,218 6/1988 Ziegler ..... 2/159

FOREIGN PATENT DOCUMENTS 0882685 7/1953 Fed. Rep. of Germany ..... 2/167

*Primary Examiner*—Louis K. Rimrodt
*Attorney, Agent, or Firm*—Ladas & Parry

[57] ABSTRACT

A method of making a garment for bendable hody parts with chain armour selects a chain armour which stretches more in a first, longitudinal direction than in a second, transverse direction 90° thereto, such a four-ring chain armour. The garment is then made with a piece of the chain armour on a bendable body part with skin which stretches when the body part is bent with the longitudinal direction thereof in the direction o the stretching and a piece of the chain armour on a bendable body part with skin which is subjected to compression when the body is bent with the longitudinal direction thereon 90° to the former, the body parts preferably being opposite sides of a joint.

8 Claims, 10 Drawing Sheets

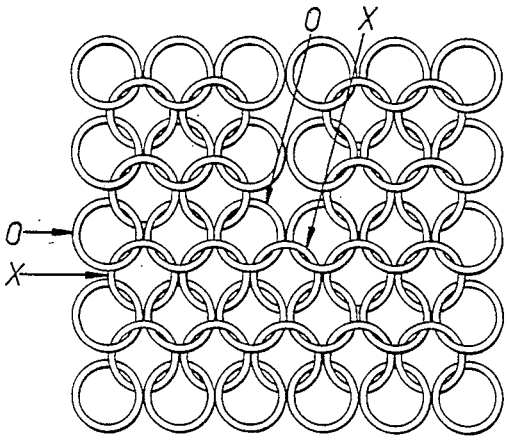
Fig.10.
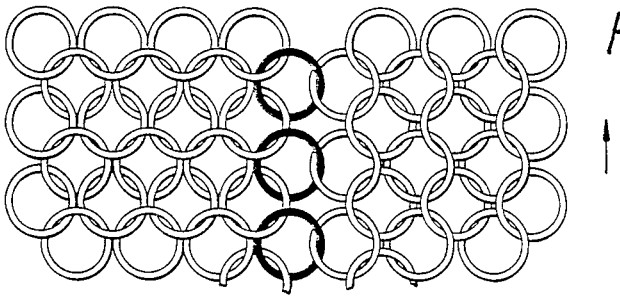
Fig.11a.
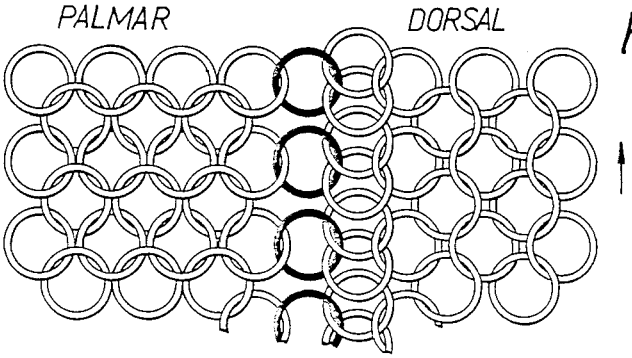
Fig.11b.
Fig.12a.
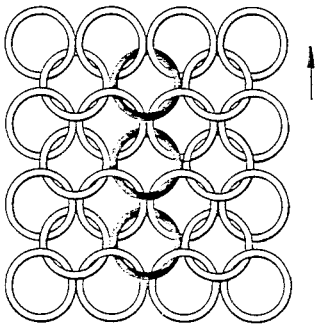
Fig.12b.
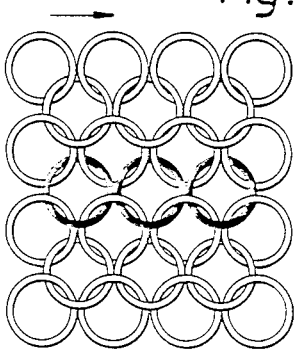

B1
B2
C1
15
A1

B3
B4
C1
C2
16
A2

B5
B6
C2
C3
17
A3

B7
B8
C3
18
A4

A1
A2
A3
A4
A
D1
D2
E
14
W3
WRIST STRAP

GLOVE OF CHAIN ARMOUR STRUCTURE

This is a divisional of co-pending application Ser. No. 124,907 filed on Nov. 24, 1987, now U.S. Pat. No. 4,802,242, which is a continuation of Ser. No. 021,592 filed Mar. 2, 1987, now abandoned, which is a continuation-in-part of Ser. No. 780,653 filed Sept. 26, 1985, now abandoned.

The present invention relates to a garment having chain armour.

In manufacturing garments like dresses, vests, jackets, trousers, etc. with chain armour, separate pieces of chain armour were previously assembled in only one orientation. This resulted in considerable impediment of the natural freedom of body movement when the user had to bend which was due to tensions, thus, impeding various professional activities.

It is, thus, an object of the present invention to eliminate said deficiencies in the manufacture of a garment with chain armour by utilizing different structure directions of the chain armour in shaping and orientating different pieces with regard to body movement so as to avoid tension in connection with various bending movements.

According to the invention the garment is, thus, characterized in that the chain armour structure on that or those parts of the body where the skin is normally stretched more or less when said part of the body is bent, is orientated 90° in relation to the structure on that or those parts of the body where the skin is subjected to compression when said part of the body is bent.

Additional features of the present invention will appear from the following claims and from the following disclosure with reference to the affixed drawings.

In order to illustrate the inventive concept in a simple manner a garment is in the following disclosed with reference to a glove in a chain armour structure, even though it will be obvious that the present invention is by no way limited to a garment of this kind. Thus, the present garment in a chain armour structure may be used to protect the body or parts of the body, e.g. in the shape of a headgear, a jacket, a vest, trousers, gloves, socks, or the like.

Figure 5A:
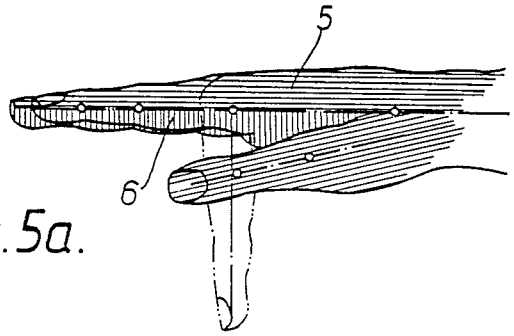
Figure 5B:
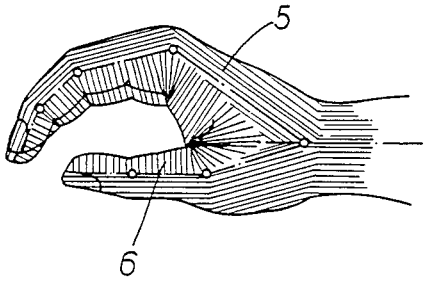
Figure 5C:
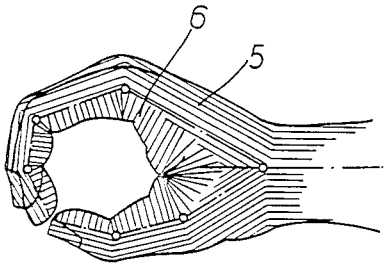

FIGS. 5*a*, 5*b*, and 5*c* illustrate the areas of stretch and compression in a stretched out hand, a half clenched hand, and in a more clenched hand.

Figure 6:
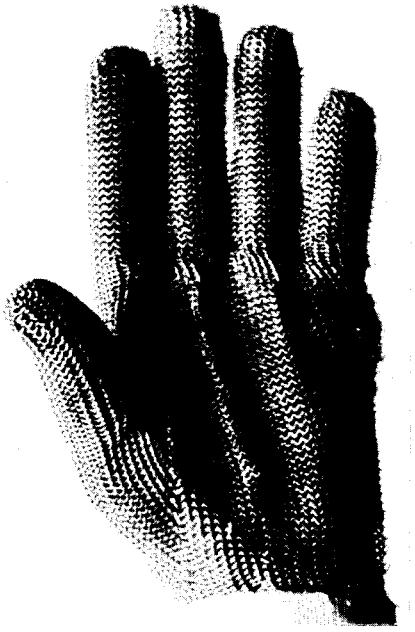
Fig. 6. PRIOR ART
Figure 7:
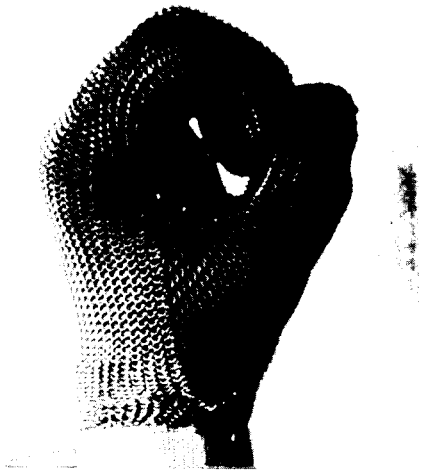
Fig. 7. PRIOR ART

FIGS. 6 and 7 show a chain armour glove of a conventional kind.

Figure 8:
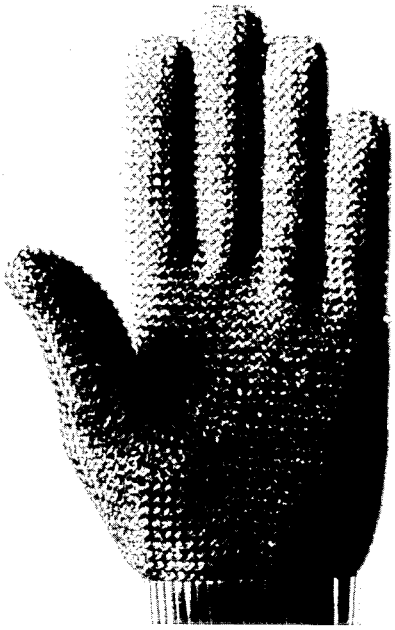
Figure 9:
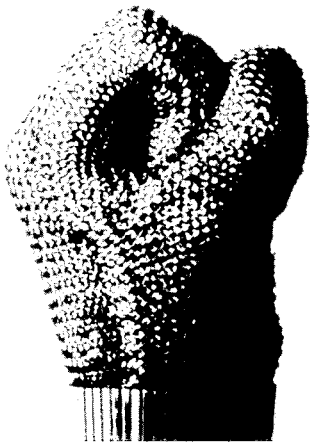

FIGS. 8 and 9 show a chain armour glove manufactured according to the present invention.

Figure 16:
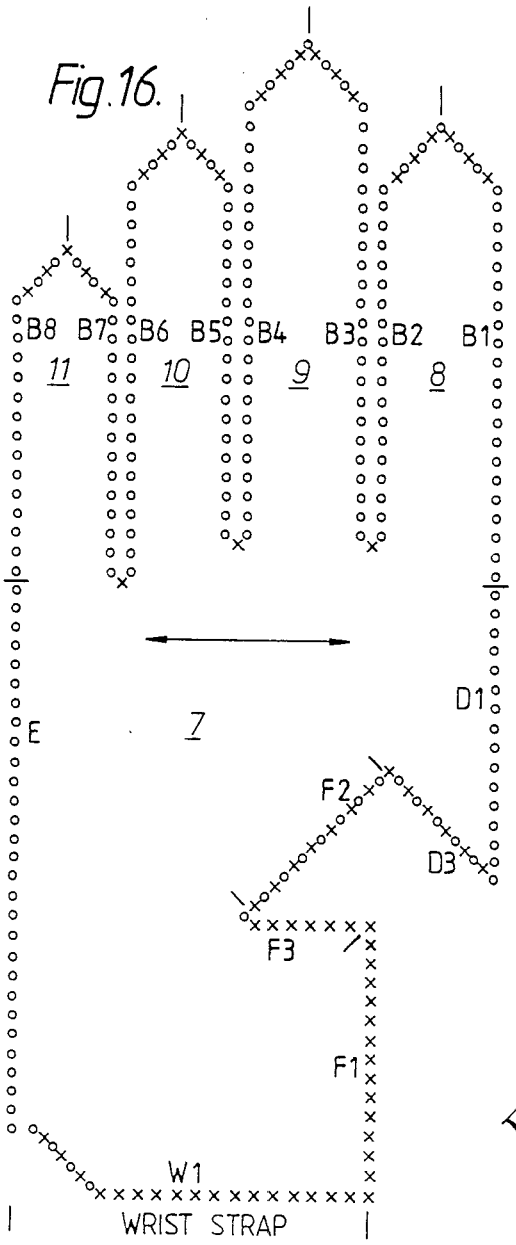

FIG. 10 illustrates a typical division of the chain armour structure, e.g. between adjacent fingers, as illustrated in FIG. 16.

FIGS. 11*a* and 11*b* illustrate two manners of connecting the palmar glove structure and the dorsal structure of a glove.

FIGS. 12*a* and 12*b* illustrate the connection between palmar/palmar structure and dorsal/dorsal structure resp.

Figure 14A:
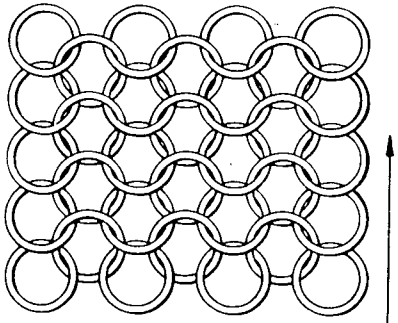
Figure 13A:
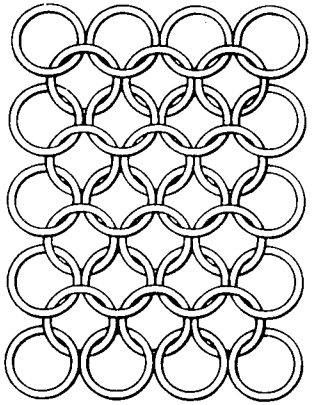

FIGS. 13*a* and 14*a* illustrate the structure of the palmar side of the glove in a stretched out and a somewhat clenched state of the hand resp., the arrow indicating the longitudinal direction of the glove.

Figure 14B:
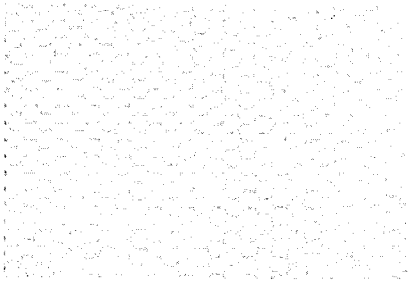
Figure 13B:
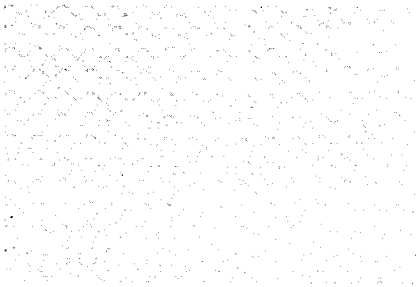

FIGS. 13*b* and 14*b* illustrate the structure of FIGS. 13*a* and 14*a* resp. in a smaller scale.

Figure 15A:
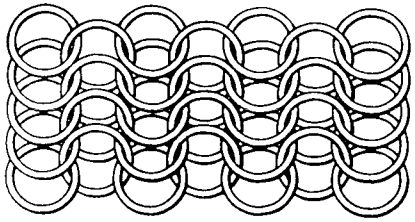

FIG. 15*a* illustrates the structure on the dorsal side of a glove, the arrow indicating the longitudinal direction of the glove.

Figure 15B:
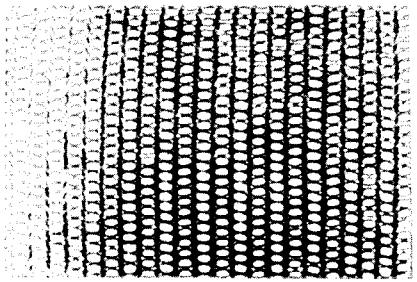

FIG. 15*b* illustrates the structure of FIG. 15*a* in a smaller scale.

Figure 17:
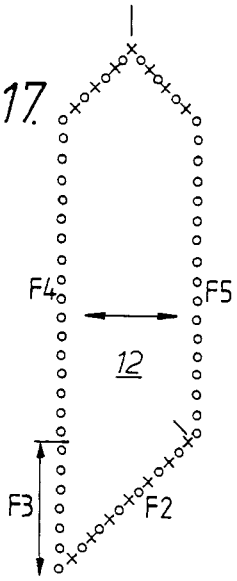

FIG. 16 illustrates a palmar part of a glove, and FIG. 17 shows the palmar thumb portion.

Figure 18:
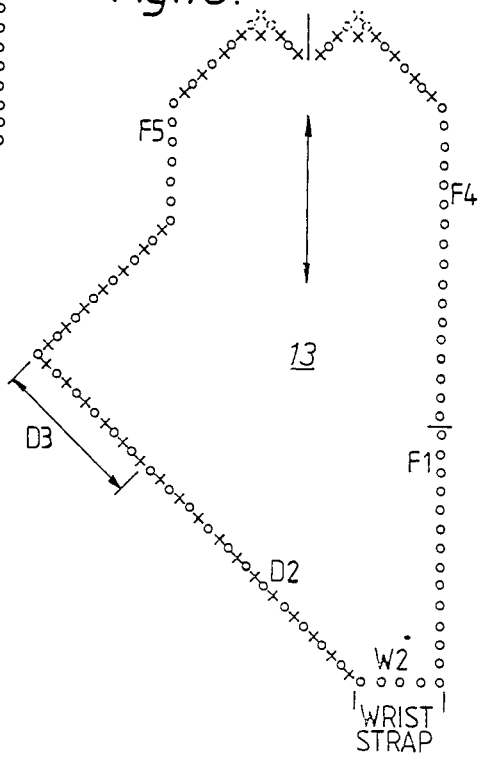

FIG. 18 shows the dorsal thumb part of the glove.

Figures 19, 20A, 20B, 20C, 20D:
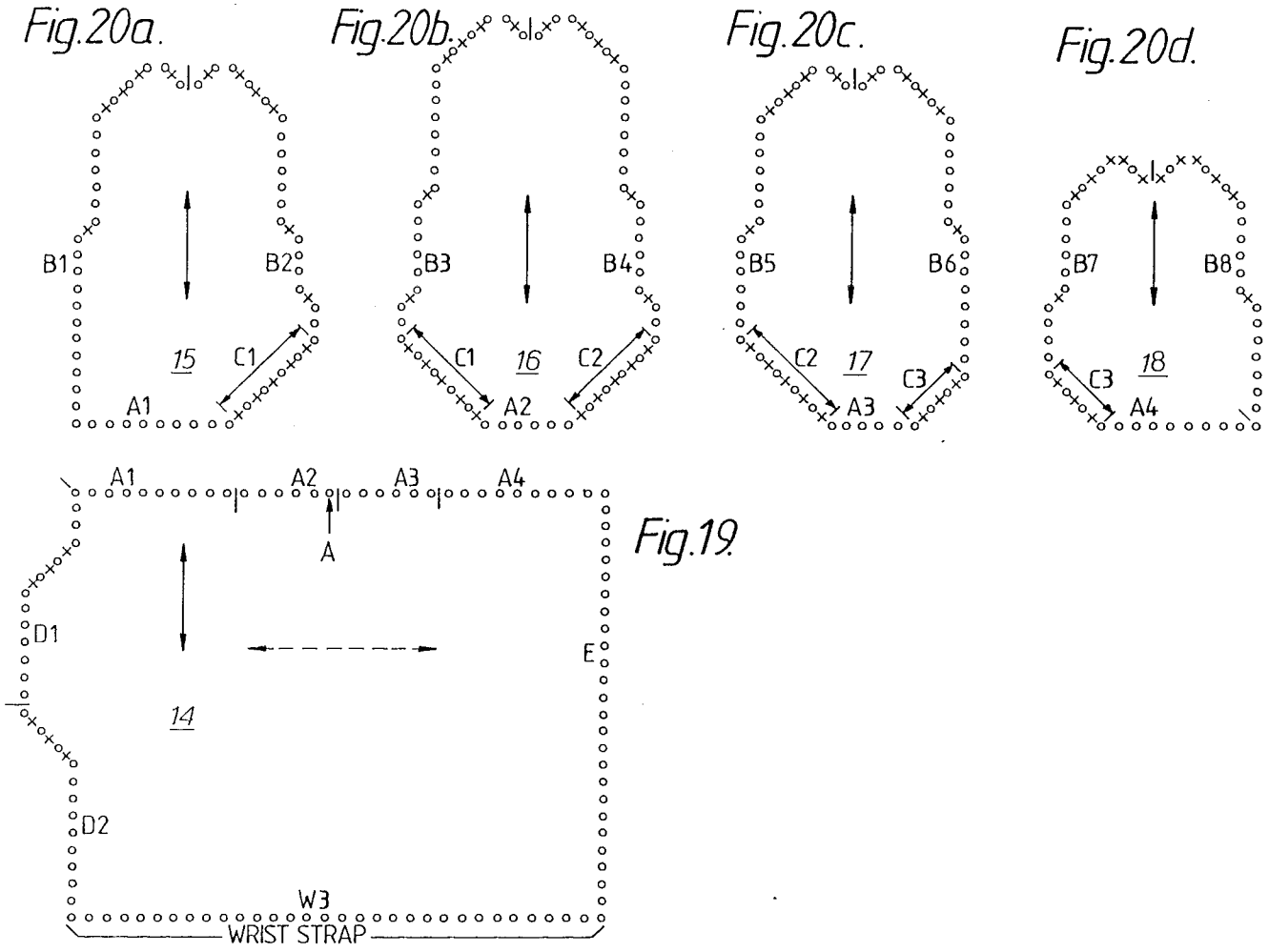

FIG. 19 illustrates the dorsal metacarpus part.

FIGS. 20*a*, 20*b*, 20*c*, and 20*d* illustrate the dorsal finger piece, the middle finger piece, the ring finger piece, and the little finger piece of a glove.

Figure 21A:
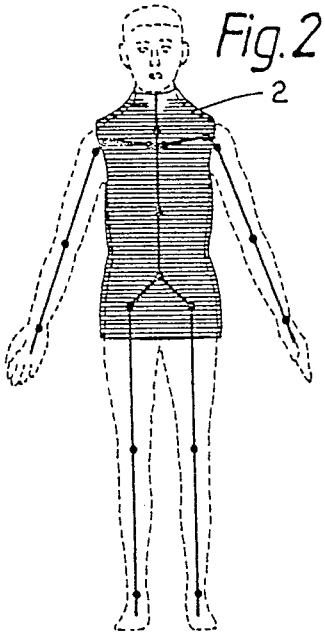
Figure 21B:
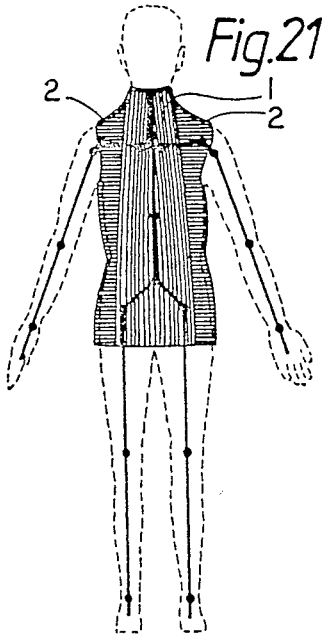
Figure 21C:
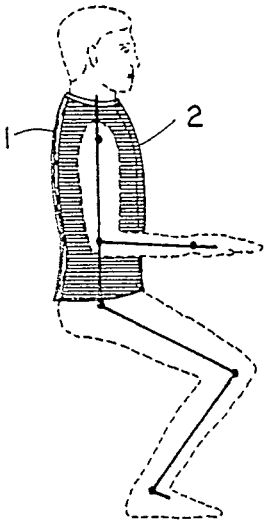

FIGS. 21*a*, 21*b* and 21*c* illustrates schematically in front, rear and side views, respectively a vest assembled according to the invention.

Figure 22A:
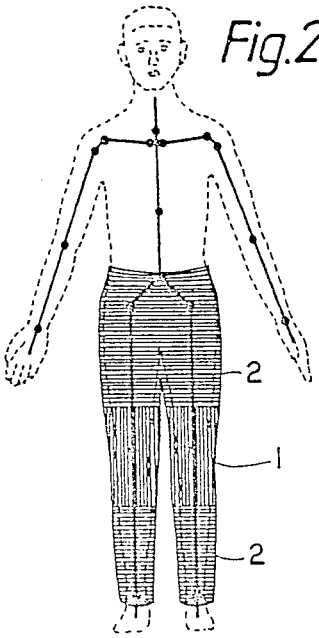
Figure 22B:
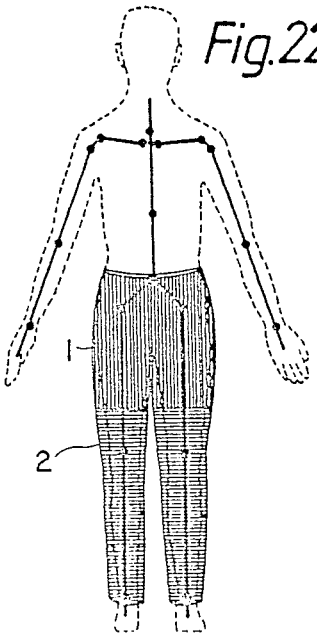
Figure 22C:
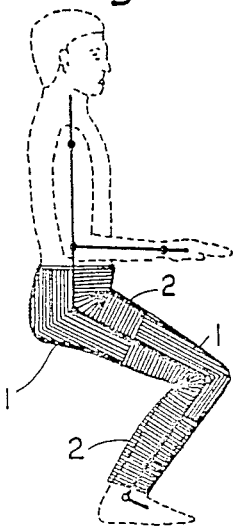

FIGS. 22*a*, 22*b* and 22*c* illustrates schematically in front, rear and side views, respectively a pair of trousers assembled according to the invention.

Figure 23A:
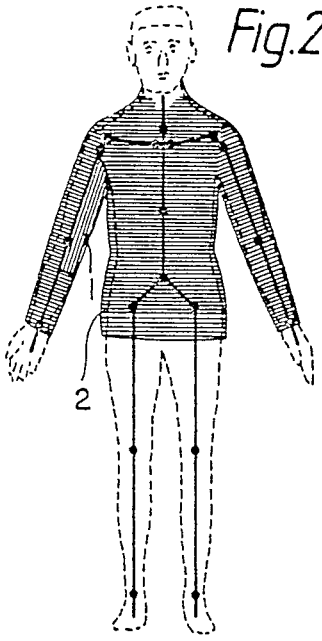
Figure 23B:
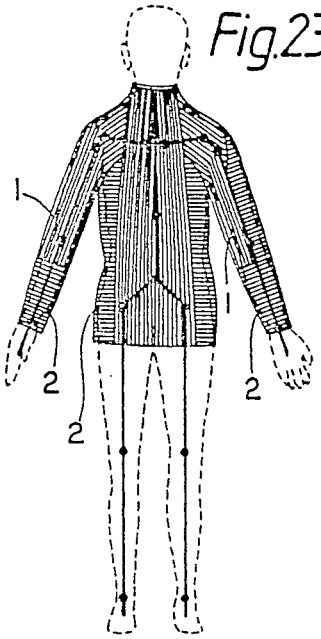
Figure 23C:
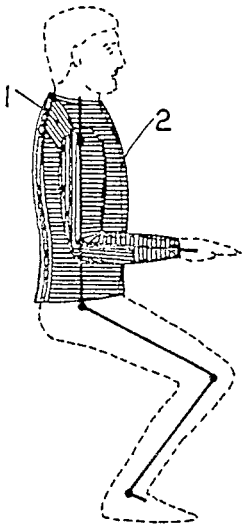

FIGS. 23*a*, 23*b* and 23*c* illustrates schematically in front, rear and side views, respectively a jacket assembled according to the invention.

Figure 24A:
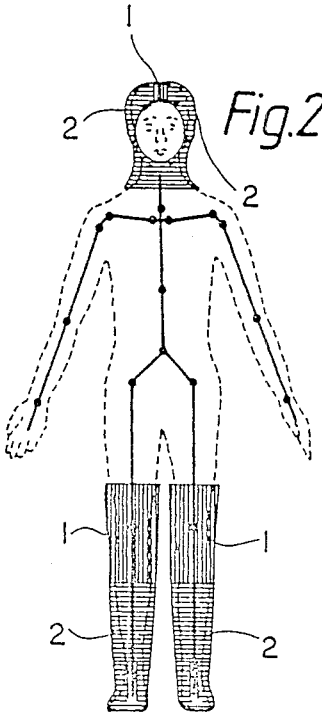
Figure 24B:
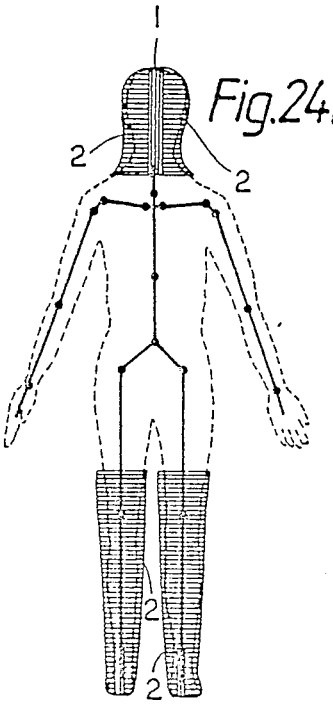
Figure 24C:
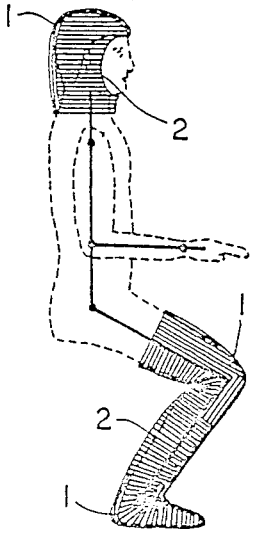

FIGS. 24*a*, 24*b* and 24*c* illustrates schematically in front, rear and side views, respectively a headgear and long socks, each of the illustrated items being assembled according to the invention.

Figure 25A:
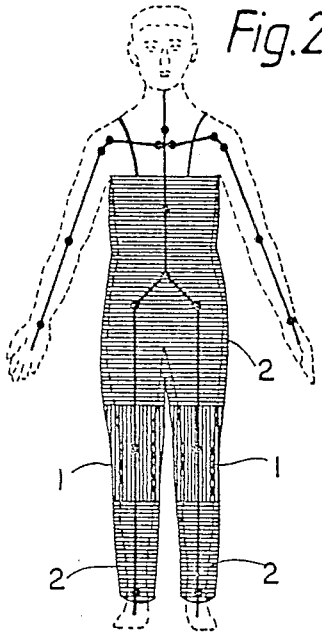
Figure 25B:
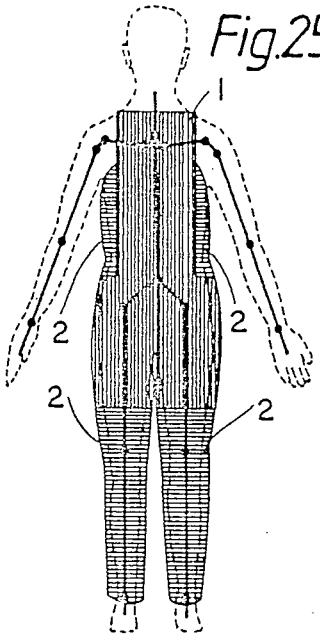
Figure 25C:
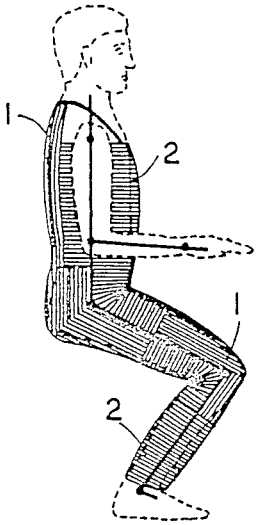

FIGS. 25*a*, 25*b* and 25*c* illustrates a typical boiler-suit in front, rear and side views, respectively.

Figure 26A:
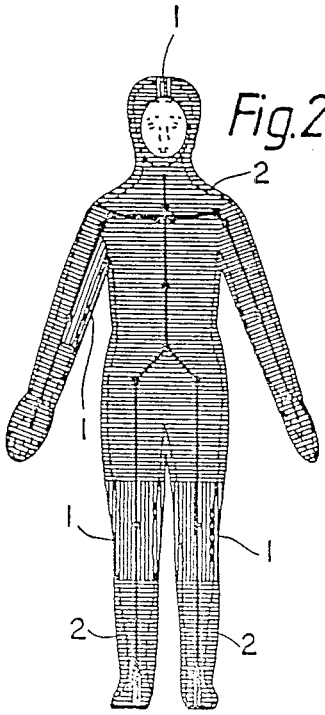
Figure 26B:
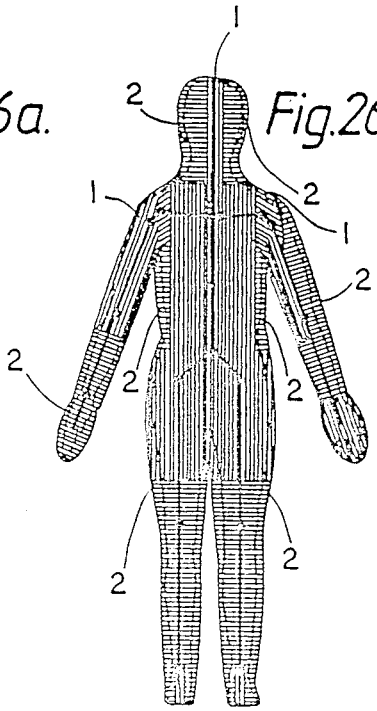
Figure 26C:
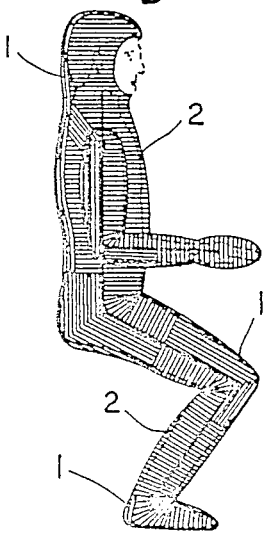

FIGS. 26*a*, 26*b* and 26*c* illustrates a full body-suit in front, rear and side views respectively and assembled according to the invention.

Figure 1:
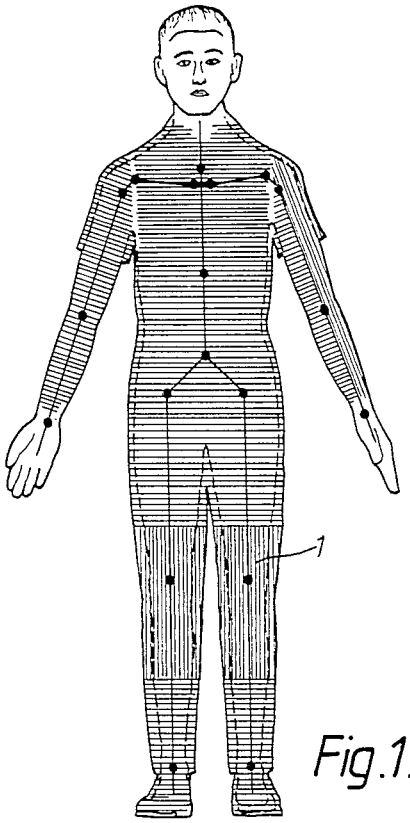
FIGS. 1 and 2 show a person, seen from in front, and from behind respectively, stretch and compression areas of the skin being indicated.
Figure 2:
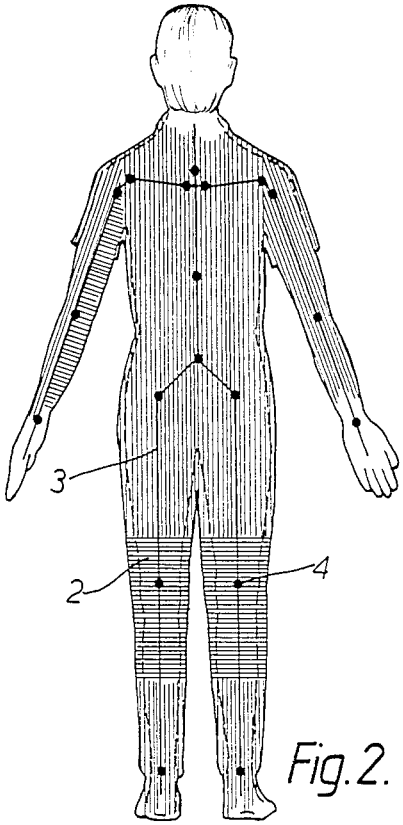
Figure 3:
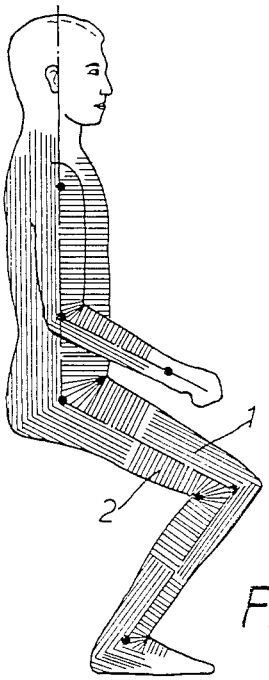
FIGS. 3 and 4 show a person in a kneeling and a sitting position respectively, and in a stooping kneeling position.
Figure 4:
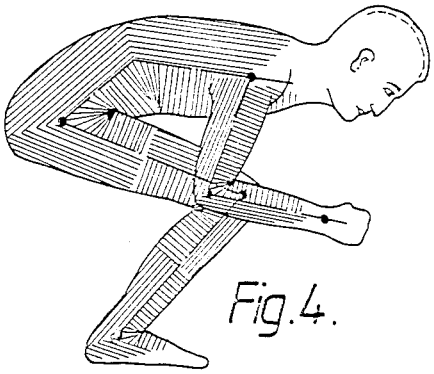

It will appear from FIGS. 1 and 2 that, e.g. the skin on the knee front is designated by lines 1 in a longitudinal direction of the body, whereas the skin in the hollow of the knee is designated by lines 2 perpendicular to lines 1. It will be understood from this, especially with reference to FIG. 3, that the skin around the knees is stretched when the knees are bent, whereas the skin in the hollows of the knee is compressed. A corresponding analysis of the other body parts will easily be made with reference to FIGS. 1–4.

It was, thus, a primary object to adapt the garment or garments in such a manner that tensions will not result in the garment when the body parts in question are bent. In FIGS. 1 and 2 the principal bone structure is generally indicated by reference number 4.

In connection with the present invention it was surprisingly found that a chain armour has the capacity of stretching to a different degree in a first direction in relation to a second direction forming an angle of 90° with said first direction. By utilizing this special feature in a ring chain armour it is possible to achieve considerably reduced tensions on the stretched parts of the body, whereas the structure on those parts of the body that are subjected to compression will at the same time perform in such a manner that a considerably reduced collection of structure material results. The structure on the stretching side of the part of the body in bending, thus, will also cause tightening of the chain armour structure material on the compression side of the part of the body in question. In this manner a garment is achieved which is to a large degree able to conform to the movement of the body in a much better way than previously known.

In order to explain the present invention in a simple manner reference is made to FIGS. 5–20, showing a garment in a chain armour structure in the shape of a glove, especially a glove of the kind that is used in connection with work with cutting tools, e.g. tools used in sloughterhouses.

Such gloves manufactured of a metal chain armour serve to protect the hand against cuts, stab wounds, tear wounds, and pinch injuries.

It is previously known that conventional chain armour gloves are based on the concept that the dorsal side of the glove is equal in size to the palmar side of the glove, i.e. designed for a stretched out hand. Due to this, conventional gloves have a width that is larger than the hand width in order to make room in front across the knuckles, which is necessary when the hand is to be bent into a gripping position. The known glove will, thus, be tight across the knuckles and the finger joints, and when the hand is clenched an excess of material will collect in the palmar region of the glove in the shape of marked folds impedimental to control as well as sensitivity in the gripping function. It will appear from FIGS. 6 and 7 that the known glove shows folds already when it sits on a stretched out hand, As shown in FIG. 7, a marked tightening of the structure occurs on the dorsal side of the glove when the hand is loosely clenched. Also, a considerable accumulation of chain armour structure occurs on the palmar side of the glove.

With the present invention, used in a glove, it is possible to avoid the disadvantages of the conventional chain armour structure, the separate pieces of the glove being divided and arranged in such a manner that the chain armour glove in its knuckle area is designed to cause an increase of the space for the knuckles when the hand is gripping, and at the same time to cause a reduction of the palmar area of the glove. Thus, the pliancy of the glove is provided in accordance with the function of the hand and advantageous conditions are provided for a maximum of sensibility and gripping control. In a glove manufactured according to the invention the structure on the palmar side of the glove will be orientated 90° in relation to the structure or parts of the structure on the dorsal side of the glove.

In FIG. 5 those portions of the hand where the skin is subjected to stretching when the hand is clenched are designated 5. In a corresponding manner those portions of the hand that are subjected to compression when the hand is clenched are designated 6.

In a glove according to the invention, as shown in FIGS. 8 and 9, no folds are formed when the hand is stretched out, and when the hand is clenched, as appears from FIG. 9, it is possible to bend the fingers and the thumb completely without any bothersome tightening on the dorsal side of the glove, and without any substantial accumulation of chain armour material on the palmar side of the hand.

In connection with the present invention it was found that a chain armour structure extends more in the longitudinal direction of the structure than in its transversel direction. This also clearly appears from FIGS. 13*a,b*, 14*a,b*, and 15*a,b*.

In the present invention it is, thus, suggested to orientate the structure on the palmar side of the glove 90° in relation to the structure or parts of the structure on the dorsal side of the glove. When the hand is clenched the structure on the dorsal side of the glove will, thus, be able to stretch considerably in the longitudinal direction of the glove, whereas the structure on the palmar side of the glove is at the same time stretched most in a direction across the center line through metacarpus. Since the structure on the dorsal sine of the glove is stretched in the longitudinal direction, the transversal dimension of the dorsal parts of the glove will at the same time be somewhat reduced and cause the structure on the palmar side of the glove to be stretched laterally, i.e. across the center line through metacarpus. Simultaneously with stretching the chain armour structure on the dorsal side of the glove, a tightening of the structure on the palmar side of the glove is, thus, achieved. The result is no tightening across knuckles and finger joints and no accumulation of textile on the palmar side of the glove. In this manner the glove is enabled to follow the movement of the hand without impeding it.

The arrows in FIGS. 16–19 indicate the principal direction of extension of the structure of various parts of the glove. In FIGS. 16–20 "x" and "o" indicate adjacent chain rows of the structure, as illustrated in FIG. 10. In order to bring about the best possible functioning of the palmar area of the glove, it will be advantageous to let the palmar metacarpus piece 7 form one part with the palmar index finger piece 8, middle finger piece 9, ring finger piece 10, and little finger piece 11, which means that the structure of said pieces 7–11 has the same orientation. Furthermore, a separate palmar thumb piece 12 is provided, as shown in FIG. 17. FIG. 18 shows that the structure of the dorsal thumb piece, the side on which the nail is, is oriented 90° in relation to the structure of the palmar side of the glove. It is also observed that the area of the dorsal thumb piece 13 is substantially larger than the area of the palmar thumb piece, e.g. 30–150% larger, as the thumb is normally flexed quite extensively and for that purpose it has, for certain applications, been preferred to have the dorsal side somewhat larger than the palmar side.

It will be obvious from FIGS. 18–20 that the dorsal side of the glove comprises totally six joinable pieces. The dorsal metacarpus piece 14 of the glove may have a main direction of extension as indicated by the full line arrow, although the orientation of the structure may in some cases be made equal to that of the structure on the palmar side of the glove, as indicated by a broken line arrow. The dorsal finger pieces of the index finger 15, the middle finger 16, the ring finger 17, and the little finger 18 respectively all show a main direction of extension as shown by the arrow. Also, the area of the dorsal finger pieces 15–18 is substantially larger than the area of the corresponding palmar finger pieces 2–5, e.g. 30–150% larger.

In accordance with the general guidelines for joining structures of the same orientated direction or structures oriented at 90° relative to each other, the sections A1, A2, A3, A4 of FIG. 19 should be joined to the sections in FIGS. 20*a*, 20*b*, 20*c* and 20*d* having the corresponding labelling. With reference to FIG. 16 the fingerstalls 15, 16, 17 and 18 of FIGS. 20*a*, 20*b*, 20*c* and 20*d* should be joined to the Palmar portions thereof 8, 9, 10 and 11, respectively, by joining the corresponding sections B1—B1, B2—B2, B3—B3, B4—B4, B5—B5, B6—B6, B7—B7 and B8—B8. It is noted that the fingerstall parts 15, 16, 17 and 18 have sections which will necessitate the joining of these fingerstall parts together at sections C1—C1, C2—C2 and C3—C3, respectively.

With reference to the FIGS. 16, 18 and 19 sections D1 and D2 should be joined to sections D1 in FIG. 16 and section D2 in FIG. 18, respectively. Section D3 in FIG. 16 should be interconnected with section D3 in FIG. 18. Section E in FIG. 16 should be interconnected with section E in FIG. 19. Section F1 in FIG. 16 should be joined with section F1 in FIG. 18. Section F2 in FIG. 16 should be joined with section F2 in FIG. 17. The same applies for section F3 in FIG. 16 which is to be joined with section F3 in FIG. 17. Section F4 in FIG. 17 should be joined with section F4 in FIG. 18, and section F5 in FIG. 17 should be joined with section F5 in FIG. 18. The glove pieces 7, 12–18 thus being interconnected will then exhibit three sections W1, W2 and W3 on the glove parts 7, 13 and 14, respectively. These sections W1, W2 and W3 should be connected to a wrist strap of any conventional type in order to prevent the glove from slipping off the hand. The sections W1, W2 and W3 should be connected to the wrist strap either by tiny rings or by attaching the said sections to the wrist strap by means of sewing with a thread.

As shown in FIGS. 11*a* and 11*b* the connection between structures of dorsal and palmar kind, i.e. in cases where the structures are orientated 90° in relation to one another, is achieved by the aid of the three ring connection. In FIG. 11 the arrow indicates the longitudinal direction of the glove. The connection between structures of equal orientation is achieved by a four ring connection, as appears from FIG. 12. The arrow indicates the longitudinal direction of the glove.

FIG. 1 illustrates a vest made according to the invention. Although other different designs may be possible, the embodiment shown in FIG. 21 is typical for the making of a vest. With the teachings of how to interconnect chain armour structures with the same orientation or with structures having a mutual orientation of 90°, it would be obvious to the expert how the vest according to FIG. 21 could be assembled, as the most difficult garment piece, viz. a glove, has been described in detail hereinabove.

The principle bone structure of the person has been generally indicated by the reference numeral 3 and the major joints in the bone structure by the reference numeral 4. Further, the chain armour structure shown in FIGS. 21–26 by horizontal lines is that which is primarily intended to be able to stretch in the horizontal direction upon bending of the corresponding part of the human body. Similarily, the chain armour structure indicated substantially by vertical lines is that structure which is intended to stretch in substantially the vertical direction upon bending of the corresponding part of the human body.

More specifically, the vest according to FIG. 21 has a front structure 19, the structure being so orientated as to be able to stretch substantially in the horizontal direction upon the bending of the upper body of the person. The structure 19 extends around to the rear part of the vest, as indicated in FIG. 21b. Those rear parts have been labelled 19'. The rear of the vest has a wide section 20 of chain armour structure which is orientated 90° relative to the chain armour structure 19, 19' and extends over the full height of the vest and, upon bending of the upper body of the person, is capable of stretching in the substantially vertical direction. Thus, when the person bends his upper body, the structure 20 will stretch in the longitudinal direction, thus laterally contract and pull the edges of the structure 19' to cause the structure 19 and 19' to stretch.

The similar philosophy is applied on the pair of trousers indicated in FIG. 22. It is noted that the pair of trousers down to the length of approximately that of a pair of shorts has its front of a structure 21 which upon bending of the person will enable the structure to be extendable in substantially the horizontal direction, whereas the rear part 22 has a chain armour structure with an orientation 90° relative to the structure 21 and capable of being stretchable in substantially the vertical direction. Around the knees of the person, the front part 23 of the trousers have a chain armour structure orientated to be stretchable substantially in vertical plane, whereas the structure 24 on the rear side is orientated at 90° to the structure 23. Below the knees, substantially at the shins it is noted that the front part 25 of the trousers have been orientated at 90° to the structure 23. Also, the structure on the rear part of the trousers is that denoted 24 in FIG. 22*b*. The reason why the structures 24 and 25 have the same orientation, is that there is no bending of the body at the region covered by the structure 25. However, to ease entering of the trousers, it would be preferable to have the orientation of the structures 25 and 24 as shown.

FIG. 23 is substantially the same as FIGS. 21, however showing a complete jacket. Again, the front of the upper body is provided with a chain armour structure 26 being orientated to be primarily stretchable in the horizontal direction, said structure 26 also extending around to the rear of the jacket as shown by reference numerals 26'. Extending over the full height of the rear of the jacket and over a wide portion thereof is a chain armour structure 27 having its orientation at 90° relative to the structures 26, 26'. Further, it is noted that the front part 28 of the arms have, when the person stands with his arms down, a chain armour structure orientated substantially like the structures 26, 26' and with the sleeve part 29 of those arms also orientated in the same manner. The rear part of the arms 30 must upon bending of the human arm be capable of stretching. Thus, the chain arm structure 30 should be orientated substantially like the chain armour structure 27.

FIG. 24 illustrates both a typical headgear as well as a pair of long socks. Substantially, the headgear is composed of a chain armour structure 31 being capable of stretching primarily in the horizontal direction, said headgear having a belt 32 and a rear neck portion 33 of a structure orientated at 90° to the structure 31, as clearly shown on FIG. 24.

The socks are composed of a portion 34 at the knees and a shin section 35 as well as a foot section 36. As regards the front part, it is noted that the portion 34 has a chain armour structure which is substantially stretchable in the vertical direction, whereas the structure 35 at the shin is of the type being stretchable in the horizontal direction, as explained also in connection with FIG. 22. As regards the foot part 36, the chain armour structure has a portion 37 of a structure of horizontal stretchability and middle portions 38 and 39 at the front and rear, respectively, being capable of stretching in substantially the vertical direction, as also more clearly illustrated on FIG. 24c.

FIG. 25*a* illustrates a typical boiler-suit according to the invention. That part of the boiler-suit which is below the waist is identical to the trousers shown in FIG. 22, and the same reference numerals used therein have also been applied in FIG. 25. It is, however, noted that the boiler-suit has a chest portion 40 which as regards the front of the boiler-suit is simply an upright extension of the structure 21. It is noted that the portion 40 has the structure 21 from the front extended around to the rear as shown in FIG. 25*b*. Also, the structure 22 above the waist extends to the top of the boiler-suit as a wide belt portion 22', the structure of the belt 22' having the same orientation as that of the structure 22, i.e. forming 90° with the orientation of the structure 21. In a conventional manner, straps 41 extend over the shoulders of the person to prevent the boiler suit from dropping. Such straps are, however, not subject matter of this invention.

The full body-suit shown in FIG. 26 is in fact a combination of the jacket shown in FIG. 23*a*, the headgear shown in FIG. 24 and the trousers in FIG. 22 being extended to include the foot-covering section 36 as also disclosed in FIG. 24*a*.

The vest in FIG. 21 could suitably be used when making a bullet-proof vest. The jacket and trousers shown in FIGS. 23 and 22, respectively, could be used by lumber-jacks or other persons requiring full protection of the body.

Further, the socks 24 could be used by persons having work which require particular protection of that part of the body. Further, the headgear according to FIG. 24*a* could be used in connection with the jacket or vest of FIGS. 23 and 21, respectively.

The boiler-suit according to FIG. 25 could be used by any workman operating with equipment or tools necessitating protection of those parts of the body as shown in FIG. 25*a*.

The full body-suit of FIG. 26*a* could suitably be used by divers to protect the body against sharp objects etc. when diving. Naturally, the body-suit, which incidentally also indicates the gloves 5, 6, could be used for any other type of protection of the human body as required.

There would appear to be no particular difficulty to put on the vest shown in FIG. 21, the trousers shown in FIG. 22, the vest shown in FIG. 23, the socks shown in FIG. 24 or the boiler-suit shown in FIG. 25. However, to fit the headgear 31 properly, a zip 42 could be located below the jaw and down to the lower edge of the headgear, or the amount of material provided could be such as to enable the headgear user to fit the headgear snugly over the head.

As regards the complete body-suit, it would be more easy to fit on the human body if a zip lock could divide the front of the body-suit as shown in lines 43 extending from the groin up to the jaw.

It will be obvious that the glove pieces shown in FIGS. 16–20 are only meant as an example elucidating how the glove may be manufactured. Within the scope of the invention there are naturally possibilities of making modifications without departing from the idea and scope of the invention as stated in the following claims.

Having described my invention, I claim:

1. In a garment comprising at least two pieces of chain armour at least for two, bending parts of a body, one body part having skin which stretches when the one body part is bent and the other body part having skin which is subjected to compression when the other body part is bent, the improvement comprising:

at least two pieces of four-ring chain armour, the four-ring chain armour consisting essentially of rings which pass through and over two adjacent rings and through and under two, other adjacent rings for defining a longitudinal direction of each piece of the four-ring chain armour along ridges formed by successive ones of the rings passing over the two adjacent rings, whereby each piece of the four-ring chain armour stretches more in the longitudinal direction than in the direction transverse thereto; and garment-making means for making a garment at least for two, bending parts of a body, one body part having skin which stretches when the one body part is bent and the other body part having skin which is subjected to compression when the other body part is bent, the garment comprising the two pieces of four-ring chain armour with the longitudinal direction of one of the pieces 90° to the longitudinal direction of the other of the pieces, whereby the one piece may be made into a portion of the garment at the one, bendable body part with the longitudinal direction thereof in the direction the skin stretches and the other piece may be made into a portion of the garment at the other, bendable body part, wherein the garment is a glove with the one piece of four-ring chain armour on the dorsal side of the glove with the longitudinal direction of the one piece longitudinally thereof and the other piece on the palmer side of the glove.

2. A garment as stated in claim 1, characterized that the structure of the dorsal metacarpus piece of the glove is orientated in the same direction as the structure on the palmar side of the glove.

3. A garment as stated in claim 2, characterized in that the structure on the palmar side of the glove is most extendible in a direction across the center line through metacarpus, and that the structure of said parts of the dorsal side of the glove being orientated 90° in relation to the structure of the palmar side is most extendible in the direction of the center line through metacarpus.

4. A garment as stated in claim 1, characterized in that the dorsal side of the glove comprises individual pieces for the thmb, the index finger, the middle finger, the ring finger, and the little finger respectively, the adjoining pieces being partly connected mutually, as well as a metacarpus piece to which said finger pieces are also partly connected, and that the palmar side of the glove comprises a palmar thumb piece, as well as a palmar metacarpus piece, an index finger piece, a middle finger piece, a ring finger piece, and a little finger piece, all in one piece.

5. A garment as stated in claim 4, characterized in that the dorsal finger pieces for the thumb, index finger, middle finger, ring finger, and little finger comprise a larger area than corresponding palmar pieces of the glove.

6. The garment of claim 1, wherein the garment-making means comprises interconnecting rings for connecting the two pieces of four-ring chain armour together, each interconnecting ring linking two rings of one of the pieces to one ring of the other piece.

7. In a garment comprising at least two pieces of chain armour for a body, the improvement comprising:

at least two pieces of four-ring chain armour, the four-ring chain armour consisting essentially of rings which pass through and over two adjacent rings and through and under two, other adjacent rings for defining a longitudinal direction of each piece of the four-ring chain armour along ridges formed by successive ones of the rings passing over the two adjacent rings, whereby each piece of the four-ring chain armour stretches more in the longitudinal direction than in the direction transverse thereto; and garment-making means for making a garment for a body, the garment comprising the two pieces of four-ring chain armour at corresponding portions of the garment on opposite sides of the garment, the longitudinal direction of one of the pieces being 90° to the longitudinal direction of the other of the pieces, wherein the garment is a glove with the one piece of four-ring chain armour on the dorsal side of the glove with the longitudinal direction of the one piece lonogitudinally thereof and the other piece of the palmer side of the glove.

8. The garment of claim 7, wherein the garment-making means comprises interconnecting rings for connecting the two pieces of four-ring chain armour together, each interconnecting ring linking two rings of one of the pieces to one ring of the other piece.

* * * * *